United States Patent [19]

Kern

[11] 4,448,319

[45] May 15, 1984

[54] SCREW CAP

[75] Inventor: Josef Kern, Hainburg, Fed. Rep. of Germany

[73] Assignee: Firma Heinrich Josef Winter, Hainburg/Main, Fed. Rep. of Germany

[21] Appl. No.: 371,496

[22] Filed: Apr. 23, 1982

[30] Foreign Application Priority Data

Feb. 6, 1982 [DE] Fed. Rep. of Germany ..... 3204201

[51] Int. Cl.[3] ..... B65D 41/04

[52] U.S. Cl. ..... 215/329; 215/318; 215/357

[58] Field of Search ..... 215/318, 329, 357, 332

[56] References Cited

U.S. PATENT DOCUMENTS

| | | | |
|---|---|---|---|
| 11,677 | 7/1891 | Potter | 215/357 |
| 1,423,592 | 1/1922 | Baldwin | 215/357 |
| 1,457,418 | 6/1923 | Baldwin | 215/357 |
| 2,770,382 | 11/1956 | Ritter | 215/329 |
| 3,734,322 | 5/1973 | Grulich | 215/329 |
| 4,161,258 | 7/1979 | Obrist | 215/329 |
| 4,180,175 | 12/1979 | Virog, Jr. et al. | 215/329 |

*Primary Examiner*—Joseph Man-Fu Moy
*Assistant Examiner*—David Fidei
*Attorney, Agent, or Firm*—Staas & Halsey

[57] ABSTRACT

The screwthread in a screw cap for a bottle has at least one gap which interrupts the screwthread, at a position which is spaced at less than 360° from the start of the screwthread whereby, if the screw cap is fitted in an angled position on to the screwthread on the bottle, the screw cap can snap over the first turn of the screwthread on the bottle in order to move into the proper position.

11 Claims, 2 Drawing Figures

SCREW CAP

BACKGROUND OF THE INVENTION

This invention relates to a screw cap for a bottle or like container and more particularly a screw cap comprising a plastic material.

With screw caps for bottles or like containers, which comprise a plastic material, there is the danger that, when the screw cap is screwed on to the bottle, for example and more particularly by means of an automatic bottle closure machine, the screw cap may be disposed in an angled or inclined position on the mouth of the bottle or the screwthread thereon. This may occur for example in automatic machinery if the start of the thread, being the bottom end of the screwthread in the cap, adjacent the open end of the cap, is so positioned relative to the screwthread on the bottle that it is at an angular distance of up to about 180° from the start of the screwthread on the bottle. In that case, when the screwthread is initially aligned with respect to the bottle, the screwthread on the screw cap comes into contact with the screwthread on the bottle over an angle of less than 180°, so that the major part of the cap screwthread projects freely beyond the screwthread on the bottle, and the screw cap tilts or tips when fitted on to the bottle, the fitting operation being performed with a certain amount of pressure. When a screw cap is tilted in this manner, it will be held fast by the automatic machinery in the tilted position while it is being screwed on to the bottle, with the result that the screw cap is not properly screwed on to the neck of the bottle and does not therefore provide a satisfactory closure.

SUMMARY OF THE INVENTION

An object of the present invention is to provide a screw cap which does not suffer from the disadvantage of being tilted on a bottle neck screwthread.

A further object of the present invention is to provide a screw cap which can be properly screwed on to a bottle by an automatic machine.

Still another object of the present invention is to provide a screw cap whose screwthread is such as to prevent the screw cap from being screwed on to a bottle or like container in an inclined position.

A still further object of the present invention is to provide a screw cap which is so designed and constructed that, being produced in a simple manner, it will assume a correctly aligned position on a screwthread on a bottle.

In accordance with the present invention, these and other objects are achieved in that the screwthread in the screw cap, which is formed for example by a raised portion moulded on the inside surface thereof, has at least one gap interrupting the screwthread, before reaching an angle of 360° from the start of the thread, which is the lower end of the thread when the cap is screwed on a bottle in a vertical position.

Thus, the screwthread has a gap which is disposed at an angular spacing of less than 360° from the start of the screwthread in the cap.

The above-mentioned gap or interruption in the cap screwthread permits the periphery of the screw cap to be more easily expanded in the region of the first turn of the screwthread so that, if the screw cap is fitted on to a bottle or like container in an angular position such that the screw cap would otherwise be in an inclined position on the screwthread of the bottle, the first turn of the screwthread in the screw cap can be snapped over the first turn of the screwthread on the bottle or container, by applying a small force pressing the screw cap on to the bottle, so that the screw cap takes up a proper level position and can be properly tightened on to the bottle or container.

Preferably, the interruption in the screwthread in the cap is disposed at a position at which the force for snapping the screwthread of the cap over the screwthread on the neck of the bottle or container when fitting the screw cap, if the screw cap is in an inclined or angled position, is on average at its lowest.

The basic consideration in regard to this embodiment of the screw cap is as follows: the screw cap will be in the position of greatest inclination relative to the bottle on which it is to be screwed, when the start of one screwthread comes to lie on the start of the other screwthread. In this case however, with the previous plastic screw caps, it was relatively easily possible for the screw cap to be adjusted into the proper level position by being snapped over the screwthread on the neck of the bottle or container so that the screw cap can then be screwed on in the proper manner. If now the screw cap is turned in the direction of being screwed on to the bottle, from the above-mentioned position at which the screw cap is at its greatest inclination, then the angle of inclination of the screw cap on the bottle gradually decreases, in accordance with the inclination or pitch angle of the screwthread; when that happens however, the force required for snapping the screwthread on the cap over the screwthread on the bottle or container increases until it reaches a maximum value, and then decreases again. Finally, the screw cap will lie with the major part of its first turn on the first turn of the screwthread on the bottle, so that the cap is no longer in an inclined or angled position.

Therefore, it is also desirable for the gap or interruption in the screwthread of the cap to be disposed at the point on the cap screwthread which is as far from the start of the screwthread of the cap as the position of the start of the cap screwthread from the start of the bottle screwthread, when the force for snapping the cap screwthread over the bottle screwthread is at its highest.

It will be seen from the foregoing considerations that, if there are otherwise no factors which might influence the situation, the position at which the gap is advantageously provided in the screwthread of the cap is at about 90° from the start of the screwthread in the cap.

The screwthreads in the cap and the bottle may have a plurality of turns, but in such a case the gap or interruption in the cap screwthread is only ever provided in the first turn of the cap screwthread.

Moreover, instead of providing just a single gap or interruption in the cap screwthread, it would also be possible to provide a plurality of such gaps or interruptions, without thereby departing from the scope of the invention.

An embodiment of a screw cap according to the present invention will now be described by way of example with reference to the accompanying drawing.

DESCRIPTION OF THE PREFERRED EMBODIMENT

Figure 1:
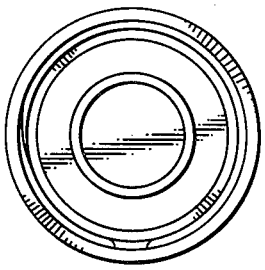
FIG. 1 shows a view from below of a screw cap, viewing into the open end thereof.

Referring now to the drawing, illustrated therein is a screw cap for screwing on to a bottle or container, the cap comprising a suitable plastic material. As will be seen from FIG. 1, the screw cap is of a generally round or circular configuration, comprising, as shown in FIG. 2 also, a peripheral wall portion and an end or cover portion joined to the peripheral wall portion by an inclined edge portion.

Figure 2:
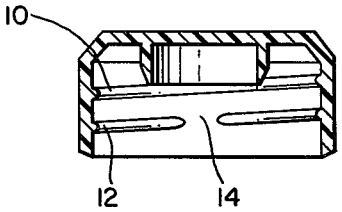
FIG. 2 shows a view of the screw cap in cross-section, illustrating the screwthread therein.

Formed on the inside surface of the cover portion of the cap and projecting downwardly in FIG. 2 is a raised circular rim which is adapted to engage into the mouth opening of a bottle on which the screw cap is screwed, thereby to enhance the closure effect of the cap.

In order to fit the screw cap on to a bottle or like container, the peripheral wall portion of the screw cap is provided on its inside surface with a screwthread as indicated at 10. The screwthread 10 may comprise one or a plurality of screwthread turns. As illustrated, the screwthread 10 is formed by a raised portion integrally moulded on the inside peripheral surface of the peripheral wall portion of the screw cap.

Reference numeral 12 in FIG. 2 is used to denote the start of the screwthread 10 in the screw cap, being the point of the screwthread which is lowest in the cap, that is to say, closest to the opening of the cap for receiving the neck of the bottle or like container. Reference numeral 14 in FIG. 2 denotes a gap or interruption in the screwthread 10. The position of the gap or interruption 14 in the screwthread 10 is such that the gap 14 is spaced at an angle of less than 360° from the start 12 of the screwthread. A preferred angular spacing between the start 12 of the screwthread and the gap 14 is for example in the region of about 90°. It will be appreciated that the screwthread 10 may have a plurality of such gaps or interruptions as indicated at 14.

It will also be seen from FIG. 2 that the ends of the screwthread at the gap, that is to say, the portions of the screwthread 10 on respective sides of the gap 14 and in the direct vicinity of the gap 14 are tapered in respect of height and/or width, as by bevelling or chamfering, to facilitate snapping the screwthread 10 over the screwthread on a bottle (not shown), in the manner described above.

As mentioned above, it is preferred for the interruption or gap 14 to be disposed at a position in the screwthread 10, at which the force required for snapping the screwthread 10 of the cap over the screwthread on the neck of the bottle or like container when fitting the screw cap thereon, if the screw cap is in an inclined or angled position on the neck of the bottle, is on average at its lowest. That position may substantially correspond to the 90° position referred to above. More particularly, the gap or interruption 14 may be disposed at the position in the screwthread 10 which is as far removed from the start 12 of the screwthread 10 as the position of the start 12 of the screwthread 10 of the cap from the start of the screwthread of the bottle, when the force required for snapping the cap screwthread over the bottle screwthread is at its highest.

It will be appreciated that although the screwthread in the cap may comprise only a single interruption or gap as illustrated at 14 in FIG. 2, the screwthread may also have a plurality of gaps or interruptions, while the screw cap may also have a screwthread comprising a plurality of turns, with the gap or interruption being provided in the first turn.

The screw cap as described above can thus be screwed on to a bottle or container, e.g. by an automatic machine, properly and without being angled on the bottle or container.

It will be realised that the above-described embodiment of the screw cap has been described by way of illustrative example and various modifications and alterations may be made in the construction in accordance with the principles of this invention without thereby departing from the scope and spirit thereof.

What is claimed is:

1. A plastic screw cap for bottle-like containers of the type having at their mouth a neck with a single external screwthread making a full uninterrupted turn, the cap comprising a mating single screwthread within the cap making at least a full turn, and wherein the screwthread has only an interruption in the screwthread of the cap at a position along the screwthread at an angular spacing of less than 360° from the start of the screwthread of the cap for enabling snapping of the lowermost turn of the screwthread of the cap over the uppermost turn of the screwthread of the container.

2. A cap as set forth in claim 1, wherein said interruption is disposed at a position in the lowermost turn of the screwthread of the cap, at which the force required for snapping the screwthread of the cap over the cooperating screwthread of the container when fitting the cap to the container is on average at its lowest if the cap is disposed in an inclined position on the container screwthread.

3. A cap as set forth in claim 1, wherein said interruption is disposed at a position in the lowermost turn of the screwthread of the cap which is as far from the start of the screwthread of the cap as the position of the start of the screwthread of the cap from the start of the screwthread of the container when the force for snapping the screwthread of the cap over the screwthread of the container is at a maximum.

4. A cap as set forth in claim 1, wherein said interruption is positioned in the lowermost turn of the screwthread of the cap spaced at about 90° from the start of the screwthread of the cap.

5. A cap as set forth in claim 1, wherein said screwthread comprises a plurality of screwthread turns.

6. A cap as set forth in claim 1, wherein said screwthread has only one interruption.

7. A cap as set forth in claim 1, wherein said screwthread of the cap has a plurality of said interruptions at angular spacings of less than 360° from the start of the screwthread.

8. A cap as set forth in claim 1, wherein the end portions of the screwthread which adjoin said interruption gradually taper in width and height towards said interruption.

9. A cap, for fitting to a mouth opening of a container having at its mouth opening a neck with a single external screwthread making a full uninterrupted turn, comprising:

a cap body formed of a plastic material having an end cover portion adapted to extend transversely across said mouth opening of said container thereby to seal said mouth opening, in the position in which the cap is fixed on the container;

a peripheral wall portion extending from said end cover portion and adapted to embrace a portion of the container around said mouth opening, thereby to hold the cap thereto;

a first screwthread portion provided on the inside surface of said peripheral wall portion and extending from a first end disposed towards the peripheral exge of said peripheral wall portion, which is remote from said end cover portion, thereby forming the start of said screwthread, to a second end; and at least one second screwthread portion having a first end disposed in line with and adjacent to but spaced from the second end of said first screwthread portion, the at least one second screwthread portion extending from its said first end to a second end which is closer to said end cover portion, along the pitch line of said screwthread portions, and making at least a full screwthread turn; and wherein the angular distance of said spacing between said second end of said first screwthread portion and said first end of said at least one second screwthread portion, from said start of the screwthread, in the peripheral direction of said peripheral wall portion, being less than 360° for enabling snapping of the lowermost turn of the screwthread portions over the uppermost turn of the container.

10. A cap as set forth in claim 9, wherein said angular distance of said spacing is about 90° from the start of the screwthread.

11. A cap as set foth in claim 9, wherein the second end portion of said first screwthread portion and the first end of said second screwthread portion taper in respect of width and height towards said spacing between said ends.

* * * * *